US006095771A

United States Patent [19]

Schelhas et al.

[11] Patent Number: 6,095,771

[45] Date of Patent: Aug. 1, 2000

[54] FUEL-FEED UNIT

[75] Inventors: Peter Schelhas, Stuttgart; Lothar Krauter, Bietigheim-Bissingen; Dietmar Schmieder, Moeglingen; Harald Lang, Markgroeningen, all of Germany

[73] Assignee: Robert Bosch GmbH, Stuttgart, Germany

[21] Appl. No.: 08/919,373

[22] PCT Filed: Oct. 31, 1996

[86] PCT No.: PCT/DE96/02072

§ 371 Date: Aug. 29, 1997

§ 102(e) Date: Aug. 29, 1997

[87] PCT Pub. No.: WO97/24531

PCT Pub. Date: Jul. 10, 1997

[30] Foreign Application Priority Data

Dec. 30, 1995 [DE] Germany ..... 195 49 210
Aug. 24, 1996 [DE] Germany ..... 196 34 253

[51] Int. Cl.[7] ..... F04B 17/00

[52] U.S. Cl. ..... 417/423.14; 415/197

[58] Field of Search ..... 417/423.1, 423.14, 417/DIG. 1; 416/241 B; 415/55.1, 55.2, 55.3, 55.4, 196, 197; 60/39.32

[56] References Cited

U.S. PATENT DOCUMENTS

| | | | |
|---|---|---|---|
| Re. 34,173 | 2/1993 | Kerber | 428/610 |
| 3,139,831 | 7/1964 | Pollak | 415/196 |
| 3,149,574 | 9/1964 | Mill | 415/204 |
| 3,535,051 | 10/1970 | Turner | 415/227 |
| 3,829,238 | 8/1974 | Speck | 415/197 |
| 4,052,133 | 10/1977 | Yeater | 415/200 |
| 4,913,619 | 4/1990 | Haentjens et al. | 415/172.1 |
| 5,472,321 | 12/1995 | Radermacher | 417/365 |
| 5,592,814 | 1/1997 | Palusis et al. | 60/271 |

FOREIGN PATENT DOCUMENTS

| | | | |
|---|---|---|---|
| 92/15785 | 9/1992 | WIPO | F02C 2/08 |

*Primary Examiner*—Timothy S. Thorpe
*Assistant Examiner*—David J. Torrente
*Attorney, Agent, or Firm*—Michael J. Striker

[57] ABSTRACT

The invention relates to a unit for conveying fuel from a supply tank to the internal combustion engine of a motor vehicle, having an electric drive motor and a flow pump (11), driven by it, which has a pump housing (16, 21) permanently connected to the unit housing (32) and forming a pump chamber (17), in which housing conveying means (12) moved by the drive motor revolve, wherein an insert (51) of wear-resistant material is disposed on the at least one housing part (16, 21) that defines the pump chamber (17), the insert forming at least part of a chamber wall (18, 19) which defines the pump chamber (17) in the direction of the axis of rotation (15) of the conveying means (12).

11 Claims, 3 Drawing Sheets

FUEL-FEED UNIT

BACKGROUND OF THE INVENTION

The invention relates to a unit for conveying fuel.

One such unit is known from German Patent Disclosure DE 40 20 521 A1. This unit has a flow pump, which has an impeller revolving in a pump chamber as its conveying means. The pump chamber is formed by an intake cap that closes off the pump housing on the intake side and by an intermediate housing. Such housing parts are usually made from metal, preferably anodized aluminum. The conveying means revolving between the housing parts is made from plastic and contains embedded glass fibers elements in order to increase its strength. After even a short period of operation, increased wear can occur in a flow pump of this kind. Dirt brought in from outside, especially, can cause abrasion of the anodized aluminum layer and of the surface of the impeller.

German Utility Model DE-U 91 02 825 also discloses a unit for conveying fuel, which has a pump chamber in which at least parts of the multiple-part pump housing are produced from ceramic material. By this means a wear-resistant wall of the pump chamber can be created which moreover is capable of lessening the development of irritating and undesired noise. This kind of pump chamber is provided in internal gear pumps. Because of the geometrically simply designed housing parts for forming a pump chamber of the internal gear pump, simple and economical production from ceramic is possible. This is not true for flow pumps, since the housing parts that form the pump chamber have a relatively complicated geometrical design.

SUMMARY OF THE INVENTION

The unit according to the invention has the advantage over the prior art that an economical design of a pump chamber is possible which moreover has a high service life, because of the at least one wear-resistant insert pointing toward the conveying means. As a result, the regions of the pump chamber that are subject to severe wear can be provided with wear-resistant inserts, so that for the remainder, inexpensive materials can be used which usually also make simple production possible. At the same time, this embodiment according to the invention has the advantage that the development of irritating and undesired noise can be lessened.

By using ceramic, a highly wear-resistant insert can be created which allows a long service life of the flow pump. Another embodiment according makes it possible for geometrically complicated housing parts to be produced inexpensively as injection molded parts made of plastic or metal. The external dimensions of the housing parts can correspond to the previous housing parts made of aluminum or metal, so that the housing parts embodied according to the invention can be processed in the same way, without changing the assembly systems. Another embodiment offers the advantage that the feed channel can be embodied in the housing part, while the insert merely needs to have an aperture in the region of the feed channel, which allows easy production of the insert. A further embodiment enables simple securing of the insert to the housing part.

BRIEF DESCRIPTION OF THE DRAWINGS

Three exemplary embodiments of the invention are shown in the drawing and described in further detail in the ensuing description.

DESCRIPTION OF THE PREFERRED EMBODIMENTS

Figure 1:
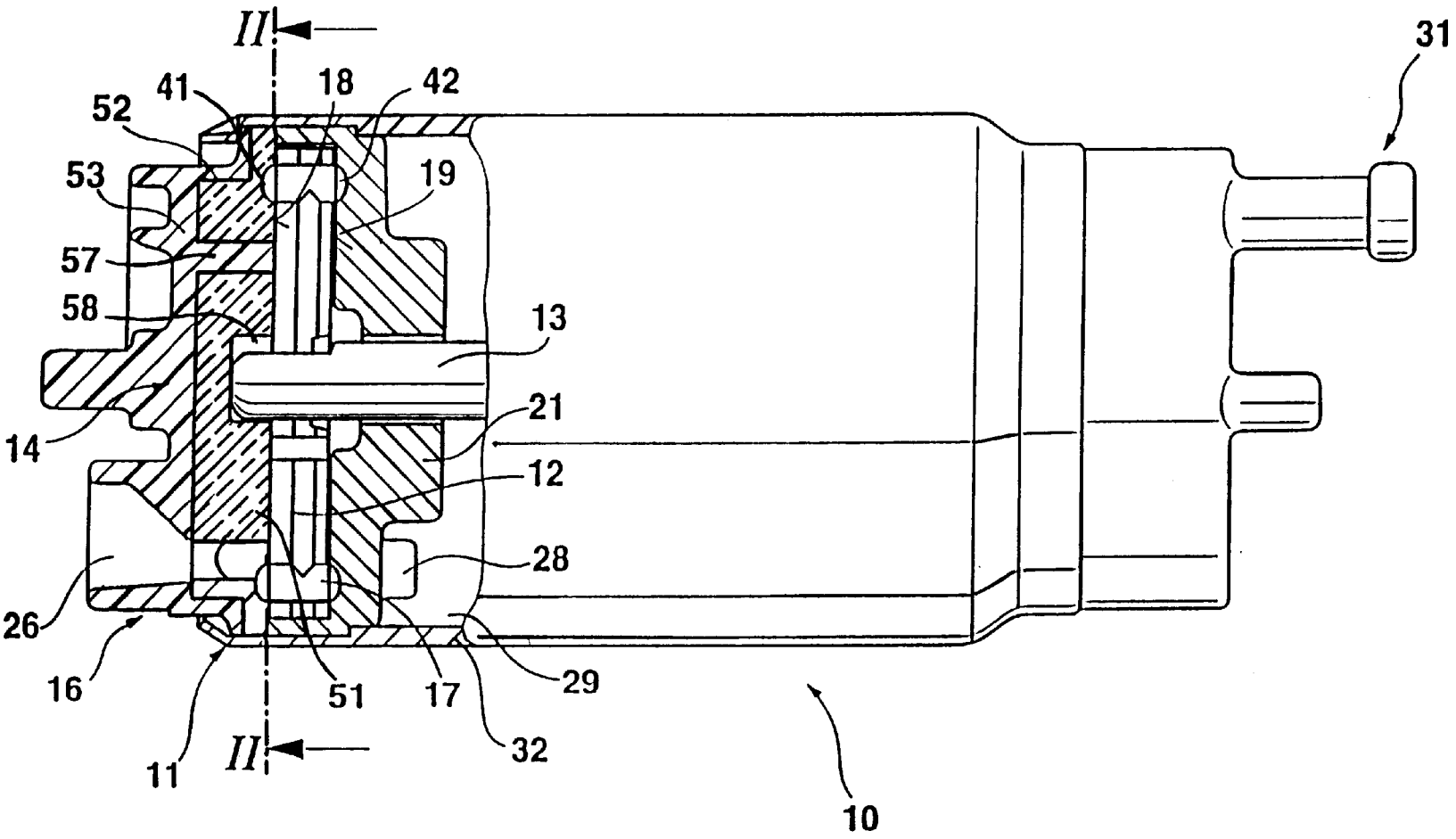
FIG. 1 shows a unit for conveying fuel with a flow pump, shown in longitudinal section, having a wear-resistant insert in accordance with a first exemplary embodiment.

A unit shown in FIG. 1 serves to convey fuel from a supply tank, not shown, to the internal combustion engine, also not shown, of a motor vehicle. The fuel conveying unit has a flow pump 11, with a conveying means 12 in the form of an impeller, which is connected in a manner fixed against relative rotation to a shaft 13 driven by an electric drive motor, not shown. The flow pump 11 may be embodied as a peripheral pump, or as in the exemplary embodiment described below as a side channel pump. The shaft 13 passes through the impeller 12 and rests on an intake cap 16. The intake cap 16 closes the fuel conveying unit 10 on its intake-side end face. The impeller 12 is disposed in a pump chamber 17, which is bounded on both sides, seen in the direction of the axis of rotation 15 of the impeller 12, by walls 18, 19.

During operation of the fuel conveying unit 10, the flow pump 11 aspirates fuel through an intake stub 26 in the intake cap 16 and presses this medium, via a pump outlet 28 in an intermediate housing 21, into a chamber in which the drive motor, not shown, is accommodated. From there, the fuel is delivered to the engine via an outlet stub or pressure stub 31. The fuel conveying unit may be disposed inside the fuel tank or outside the fuel tank.

Figure 2:
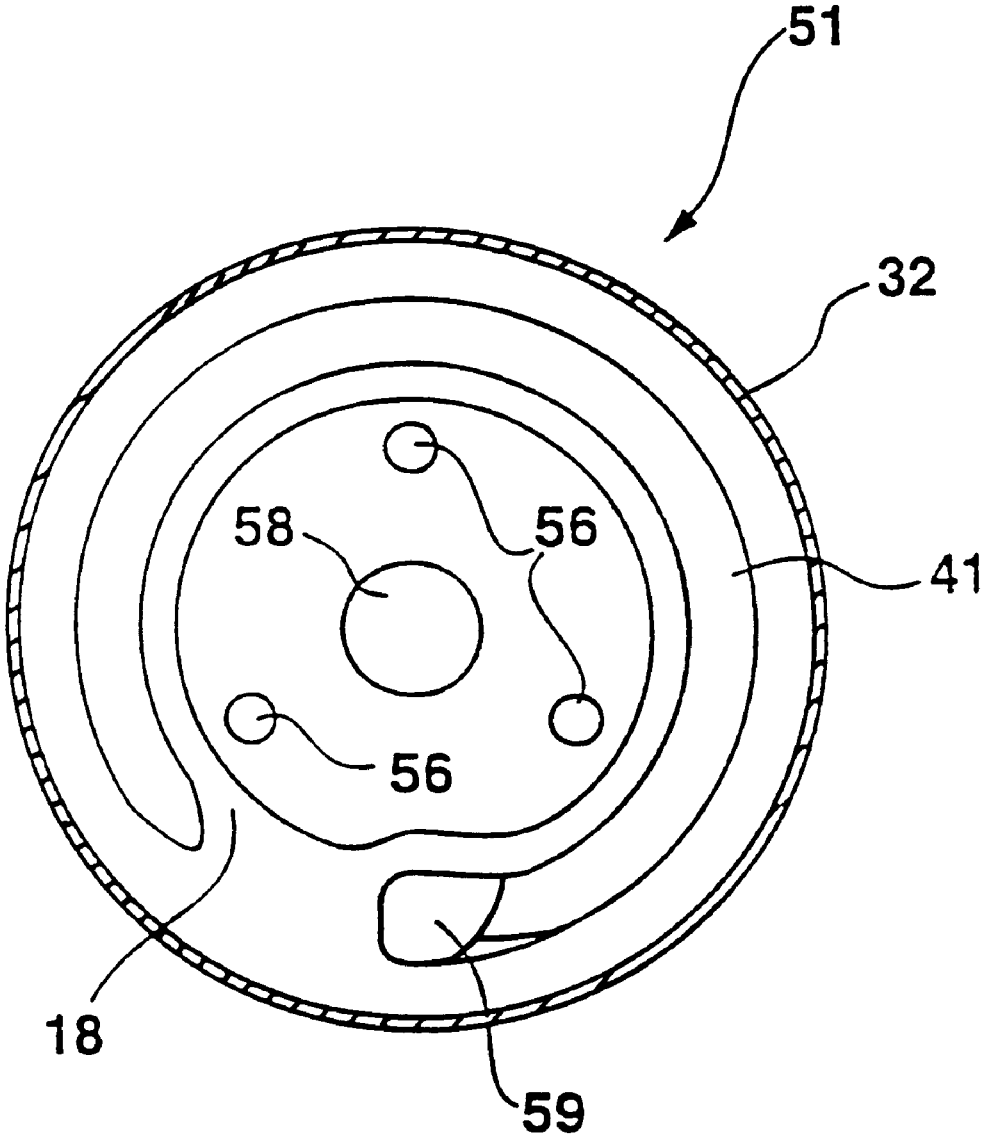
FIG. 2 is a front view in the direction of the arrow II in FIG. 1 of the wear-resistant insertion.

The intake cap 16, in the first exemplary embodiment of the flow pump shown in FIGS. 1 and 2, is embodied in two parts and has a wear-resistant insert 51 which is preferably of ceramic. This insert 51 is received in a receptacle 52 of a plastic housing portion 53 of the intake cap 16. The receptacle 52 of the housing portion 53 is substantially U-shaped in profile, seen in longitudinal section, and the insert 51 is inserted into it. The insert 51 can be joined to the housing portion 53 nonpositively and/or positively. It can also be provided that the insert 51 is inserted into the receptacle 52 or clipped in place or snapped in detent fashion, or partly spray-coated with material of the housing portion 53. Because the housing portion 53 is made of plastic, it can also easily be produced, for instance by injection molding, with a complicated outer contour of the intake cap 16. This has the further advantage that the intake cap 16 can be processed in already existing assembly systems without conversion.

The insert 51 is substantially platelike in embodiment, and in the first exemplary embodiment shown in FIG. 2, the insert 51 forms the entire wall 18 and has a feed channel 41. Alternatively, it may also be provided that the insert 51 forms only part of the wall 18, while the remainder of the wall 18 is formed by the housing portion 53. In particular, the insert 51 forms the wall 18 at the place where the impeller 12, as a consequence of pressure forces occurring during operation of the flow pump 11, is braced against the wall 18 in the direction of its axis of rotation 15. For instance, the insert 51 may be located annularly near the outer circumference of the impeller 12, outside the feed channel 41, or may be located in the form of a disk inside the feed channel 41. The insert 51 has bores 56, which are engaged by protrusions 57 of the housing portion 53 in order to fix the housing portion. The insert 51 also has a bore 59, which is aligned with the intake stub 26, so that fuel can flow into the pump chamber 17. The insert 51 can also have a recess 58 into which the end of the shaft 13 plunges.

In the manner described above, the intermediate housing 21 may also have a correspondingly embodied insert 51. By the combination of materials of the plastic impeller 12 and at least one ceramic wall 18 or 19 adjoining it, a wear-resistant design of the flow pump 11 can be achieved, which moreover prevents unpleasant and desired development of noise. It may be provided that the insert 51 is also made of some other alternative wear-resistant material, so that in adaptation to the material of the impeller 12, a wear-resistant and noise-abating effect is attained.

Figure 3:
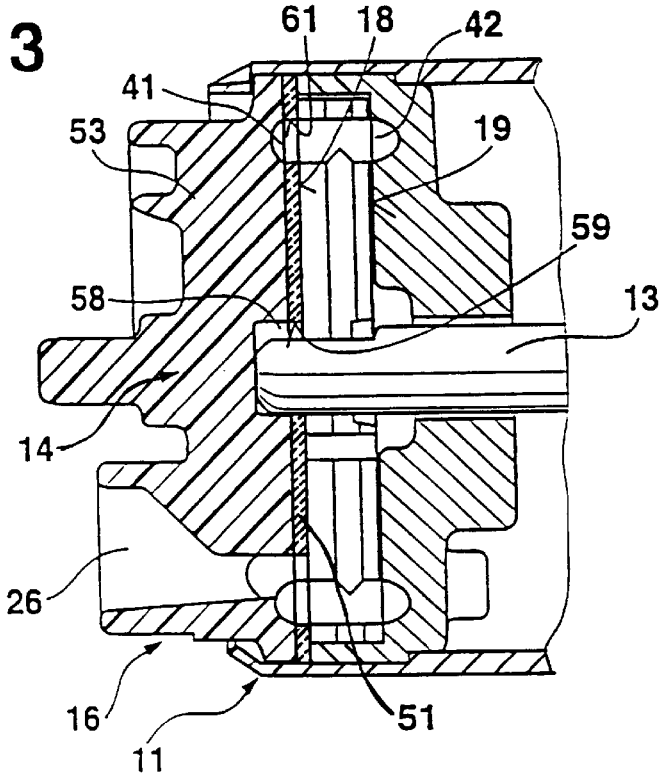
FIG. 3 shows the flow pump in longitudinal section with the insert in accordance with a second exemplary embodiment.

In a version of the flow pump in accordance with a second exemplary embodiment, shown in FIG. 3, the insert 51 is embodied with a reduced thickness, so that it essentially forms only a wear-resistant stop face for the impeller 12. The insert 51 can then be embodied for instance as a coating applied to the housing portion 53 of the intake cap 16. Alternatively, the insert 51 may be embodied as a thin small plate, which is connected to the housing portion 53, for instance being spray-coated with plastic material of the housing portion 53. As in the first exemplary embodiment, the insert 51 comprises wear-resistant material, especially ceramic. The insert 51 may have a thickness ranging from approximately 0.1 mm to several millimeters. Unlike the first exemplary embodiment, however, here the feed channel 41 is embodied in the housing portion 53, and the insert 51 needs to have a suitably shaped aperture 61 only in the region of the feed channel 41. This enables simpler production of the insert 51 in accordance with the second exemplary embodiment, compared to the insert of the first exemplary embodiment. The insert 51 has a through bore 59, through which the shaft 13 passes, and the housing portion 53 has the bore 58 into which the end of the shaft 13 plunges.

Figure 4:
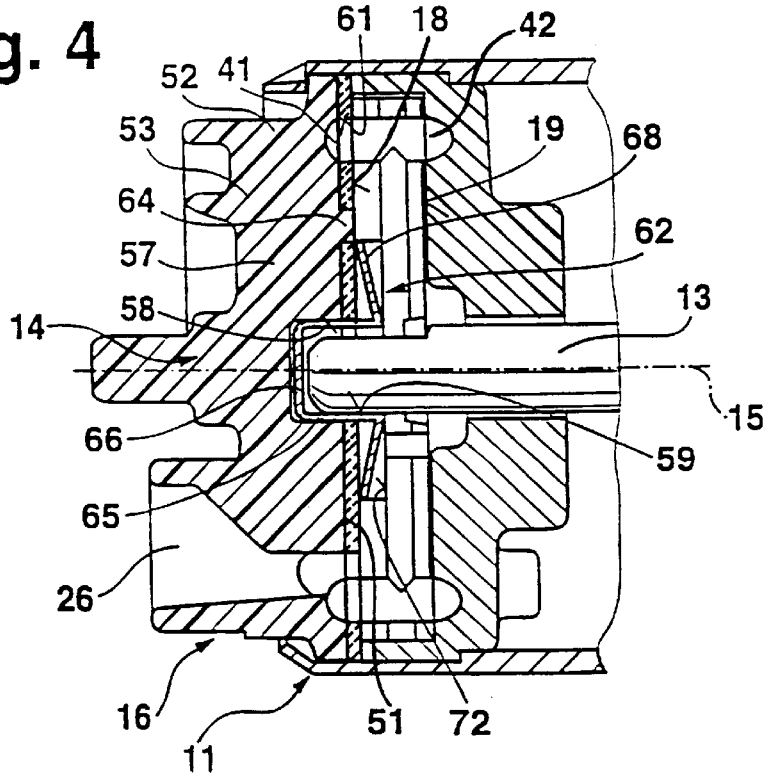
FIG. 4 shows the flow pump in longitudinal section with the insert in accordance with a third exemplary embodiment.

FIG. 4 shows a version of the insert 51 in accordance with a third exemplary embodiment. Here the insert 51 is platelike in embodiment. The feed channel 41 is embodied in the housing portion 53, and in the region of the feed channel 41 the insert 51 has a suitably shaped aperture 61. The insert 51 comprises wear-resistant material, especially ceramic. The insert 51 is retained on the housing portion 53 by means of a resilient retaining element 62, at least in the direction of the axis of rotation 15 of the impeller 12. In the direction of rotation about the axis of rotation 15, the insert 51 may be fixed positively, for instance via at least one protrusion 64 of the housing portion 53 engaging it. The retaining element 62 may for instance, as shown in FIG. 4, have a protrusion 65, which protrudes through a continuous bore 59 in the insert 51 and is fixed, for instance by press-fitting, in a bore 58 in the housing portion 53. On its end located outside the bore 58, the retaining element 62 has a collar 68, which protrudes past the bore 59 and is resiliently deformable in the direction of the axis of rotation 15 of the impeller 12. The collar 68 may have a plurality of radial slits, so that it is made up of a plurality of segments. The collar 68 rests in the prestressed state with its edge on the side of the insert 51 remote from the housing portion 53, and it keeps the insert 51 in contact with the housing portion 53 in the direction of the axis of rotation 15. The protrusion 65 may be embodied as hollow, and the shaft 13 of the drive motor can plunge into it, while the bottom 66 of the protrusion 65 served as a support for the shaft 13 in the direction of the axis of rotation 15. By way of example, the retaining element 62 may be embodied as a deep-drawn sheet-metal part. The impeller 12 has a recess 72, toward the insert 51, into which the retaining element 62 plunges with its collar 68, so that the impeller 12 can come to rest in the direction of its axis of rotation 15 not on the retaining element 62 but rather on the insert 51. Instead of the retaining element described above, some differently shaped resilient retaining element may also be provided, by which the insert 51 is held in contact with the housing portion 53 in a prestressed fashion.

What is claimed is:

1. A unit for conveying fuel from a supply tank to an internal combustion engine of a motor vehicle, the unit comprising a unit housing; an electric drive motor; a flow pump driven by said electric drive motor and having a pump housing which is permanently connected to said unit housing, said pump housing forming a pump chamber, said flow pump further having conveying means located in said pump housing and moved by said drive motor; an insert of wear-resistant material located in a part of said pump housing which at least partially defines said pump chamber, said insert forming at least a part of a chamber wall which defines said pump chamber in a direction of an axis of rotation of said conveying means; a resilient retaining element which retains said insert at least in the direction of the axis of rotation of said conveying means while said retaining element acting as a support in the direction of the axis of rotation of said conveying means, for a shaft that drives said conveying means.

2. A unit for conveying fuel from a supply tank to an internal combustion engine of a motor vehicle, the unit comprising a unit housing; an electric drive motor; a side channel flow pump driven by said electric drive motor and having a pump housing which is permanently connected to said unit housing, said pump housing forming a pump chamber, said flow pump further having conveying means located in said pump housing and moved by said drive motor; an insert of wear-resistant material located in a part of said pump housing which at least partially defines said pump chamber, said insert forming at least a part of a chamber wall which defines said pump chamber in a direction of an axis of rotation of said conveying means, said insert being platelike and embodying a circumferential feed channel.

3. A unit for conveying fuel from a supply tank to an internal combustion engine of a motor vehicle, the unit comprising a unit housing; an electric drive motor; a side channel flow pump driven by said electric drive motor and having a pump housing which is permanently connected to said unit housing, said pump housing forming a pump chamber, said flow pump further having conveying means located in said pump housing and moved by said drive motor; an insert of wear-resistant material located in a part of said pump housing which at least partially defines said pump chamber, said insert forming at least a part of a chamber wall which defines said pump chamber in a direction of an axis of rotation of said conveying means, said insert being platelike; said pump housing having a circumferential feed channel, said insert being provided with a correspondingly shaped circumferential opening in a region of said feed channel.

4. A unit as defined in claim 3, wherein said insert is composed of ceramic.

5. A unit as defined in claim 3, wherein said housing part on which said insert is located is composed of plastic.

6. A unit as defined in claim 3, wherein said housing part on which said insert is located is formed as an intake cap.

7. A unit as defined in claim 6, wherein said pump housing has another housing part which is formed as an intermediate housing dividing said pump chamber from the chamber in which said drive motor is located.

8. A unit as defined in claim 3, wherein said insert is nonpositively connected to said one housing part.

9. A unit as defined in claim 3, wherein said insert is positively connected to said one housing part.

10. A unit as defined in claim 3, wherein said insert has a substantially smaller thickness than said at least one housing part and is formed as a coating applied on said at least one housing part.

11. A unit as defined in claim 3, wherein said insert has a smaller thickness than said one housing part and is formed as a spray coating applied on said one housing part.

* * * * *